United States Patent [19]

Mitchell et al.

[11] 4,255,885

[45] Mar. 17, 1981

[54] APPARATUS FOR CONTROLLING THE POSITION OF THE PIVOTING FLOOR AND STRIKEOFF BLADE OF AN EARTHMOVING SCRAPER

[75] Inventors: Roger R. Mitchell, Plainfield; Robert J. Trayler, Braidwood; Eugene M. Wilson, Joliet, all of Ill.

[73] Assignee: Caterpillar Tractor Co., Peoria, Ill.

[21] Appl. No.: 116,349

[22] PCT Filed: Nov. 1, 1979

[86] PCT No.: PCT/US79/00927

§ 371 Date: Nov. 1, 1979

§ 102(e) Date: Nov. 1, 1979

[51] Int. Cl.[3] ..... E02F 9/28

[52] U.S. Cl. ..... 37/126 AE; 200/61.44; 200/286

[58] Field of Search ..... 37/124 R, 126 R, 126 AE, 37/129; 200/52 R, 61.44, 238, 286

[56] References Cited

U.S. PATENT DOCUMENTS

| | | | |
|---|---|---|---|
| 2,873,332 | 2/1959 | Williams | 200/286 X |
| 3,235,692 | 2/1966 | Kucera | 200/286 X |
| 3,916,545 | 11/1975 | Hochmann et al. | 37/126 AE |
| 3,952,432 | 4/1976 | Boersma | 37/126 AE |
| 4,133,122 | 1/1979 | Girard et al. | 37/126 AE |

*Primary Examiner*—E. H. Eickholt

*Attorney, Agent, or Firm*—Phillips, Moore, Weissenberger, Lempio & Majestic

[57] ABSTRACT

An earthmoving scraper has a pivoting floor which pivots from a closed position to an open position to dump and spread material previously loaded into the bowl of the scraper. Various types of earth being loaded and spread require different dump openings of the pivoting floor and varying heights of the strikeoff blade which spreads the dumped earth. Heretofore, it has been difficult for the operator of the earthmoving scraper to selectively position the pivoting floor and strikeoff blade to insure a specific dump opening and a specific height of the earth material as it is spread. The present invention provides a switch (36) for controlling the hydraulic cylinder (34) which positions the pivoting floor (26), a switch actuator (66), and a plurality of mounting positions for the switch actuator (66), thereby selectively controlling the dump opening of the pivoting floor (26) and the height of the strikeoff blade (27).

7 Claims, 7 Drawing Figures

APPARATUS FOR CONTROLLING THE POSITION OF THE PIVOTING FLOOR AND STRIKEOFF BLADE OF AN EARTHMOVING SCRAPER

TECHNICAL FIELD

The present invention relates to earthmoving scrapers and in particular to means for selectively controlling the position of the pivoting floor and strikeoff blade thereof.

BACKGROUND ART

One type of present earthmoving scraper includes a bowl assembly with a pivotable floor which is in the closed, substantially horizontal position during the earth-gathering mode and can be pivoted rearwardly to an almost vertical position for the fully opened, dirt dumping and spreading mode. Depending on the type of earth being spread, that is to say, for example, whether it has a particular clay or sand or rock content, and depending upon the desired thickness of the earth layer to be spread, it is advantageous to be able to open the pivoting floor a predetermined amount. Thus, the operator is able to control the rate of flow of earth from the bowl and also to simultaneously set the strikeoff blade of the scraper which is attached to the leading edge of the pivoting floor at a desired level to accomplish the appropriate level of spreading.

Heretofore, the operator of the earthmoving scraper, being unable to see the position of the strikeoff blade, had to guess as to the position thereof. Consequently, the operator did not know the exact level of the earth being spread until he was into the spreading operation and could view the level of earth coming out of the scraper.

DISCLOSURE OF THE INVENTION

The present invention is directed to overcoming one or more of the problems as set forth above. In one aspect of the invention, an apparatus is provided for selectively controlling the position of a member relative to a frame. The apparatus includes a switch for controlling the position of the member and first securing means for securing the switch to either one of said members or said frame. Further, actuation means are provided for actuating said switch and second securing means are provided for selectively securing said actuation means to the other of said member or said frame in a plurality of positions. The second securing means includes a bracket secured to the other of said member or said frame, which bracket defines a first leg and a second leg. The second securing means also includes an adjuster plate on which said actuation means is mounted and mounting means for mounting said plate to one of said legs of said bracket in one or more positions.

In another aspect of the invention, the adjuster plate includes first, second and third apertures and each of said legs includes first and second apertures. Groupings of two of said apertures of said plate are selectively alignable with said apertures of each of said legs to selectively positioning said plate relative to said bracket. Further, means are provided for selectively securing the plate to the bracket in one of the above aligned positions.

In yet another aspect of the invention, the first, second and third apertures of said adjuster plate form the corners of a triangle. The first and second apertures of said plate are selectively alignable with the first and second apertures of each of said legs of said bracket and said second and third apertures of said plate are selectively alignable with the first and second apertures of each of said legs of said bracket, with the plate rotated substantially 180°.

In yet another aspect of the invention the frame is of a type used on an earthmoving scraper and the member includes a member of the bowl assembly which has a pivotable floor and strikeoff blade. Thus, the invention allows for the selective positioning of the pivoting floor of the bowl and the strikeoff blade to determine the rate of discharge of the earth from the bowl of the scraper and also the height of the strikeoff blade above the ground, thereby determining the depth of the material being spread.

Therefore, the present invention allows the operator of the earthmoving scraper to preposition the actuating means. Once the actuation means is positioned, said actuating means will automatically actuate the switch to deactivate the hydraulic circuit controlling the rotation of the floor and thus the opening of the bowl and the level of the strikeoff blade. Such actuation occurs automatically without the inspection by the operator, and thus there is no guesswork involved in setting the level of the strikeoff blade and the rate of discharge of material from the bowl assembly. Once the material is discharged from the bowl, the switch can be overriden to return the pivoting floor to the closed position preparatory to again filling the bowl with earth, or the floor can be opened somewhat more to a maximum open position.

BASIC MODE OF CARRYING OUT THE INVENTION

Figure 1:
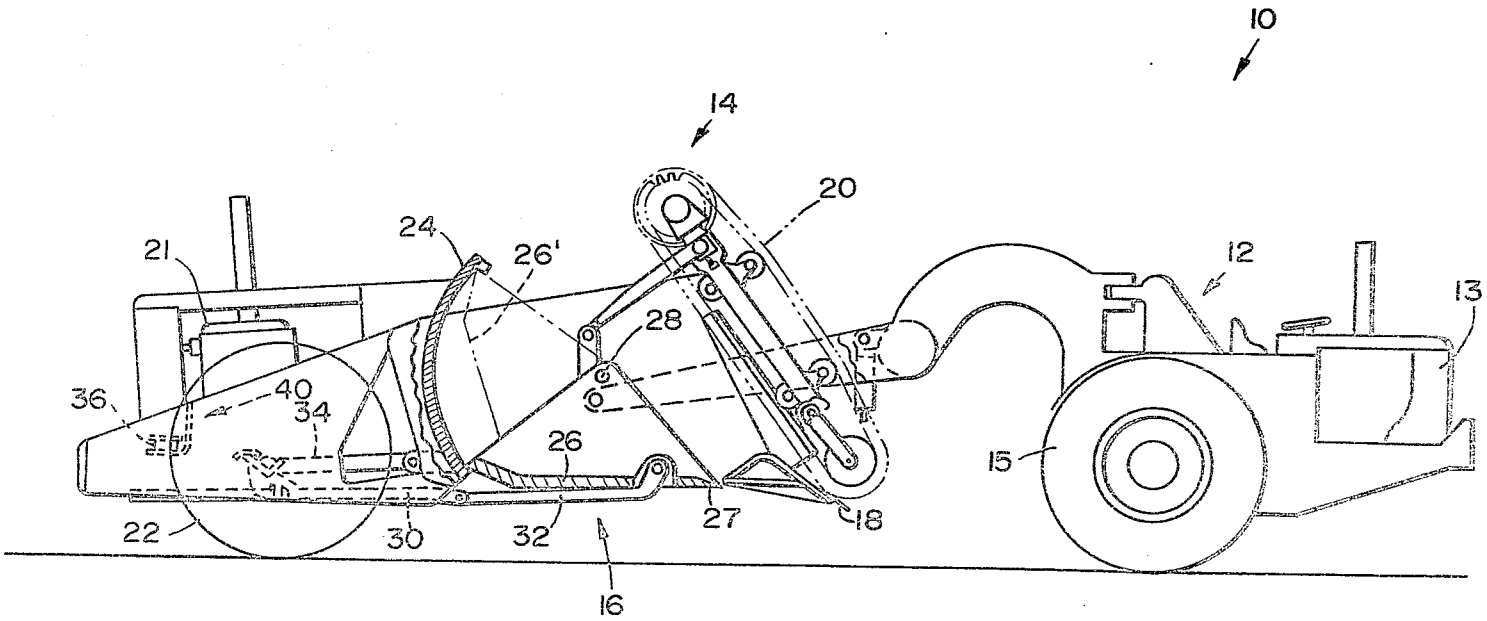
FIG. 1 is a side view, partially cut away and partially sectioned, of an earthmoving scraper incorporating the present invention.

With reference to the drawings, and in particular to FIG. 1, an earthmoving scraper is depicted and generally noted by the numeral 10. Scraper 10 includes a tractor 12 having a motor means 13 for driving front wheels 15. Tractor 12 is pivotally connected to and pulls a scraper assembly 14. Scraper assembly 14 includes a bowl assembly 16, a laterally extending earth cutting edge 18 and an elevator mechanism 20 for delivering the earth cut by the cutting edge 18 into the bowl assembly 16. Scraper assembly 14 may also include a second motor means 21 which drives rear wheels 22.

Bowl assembly 16 includes an arcuately shaped rear wall 24 and a pivoting floor 26 pivotal at pivot point 28. A strikeoff blade 27 affixed to floor 26 determines the height of the material discharged from bowl assembly 16. Rotating floor 26 has a fully closed, substantially horizontal position as indicated in FIG. 1 and a fully open, substantially vertical position as indicated by the phantom line and by the numeral 26' in FIG. 1. A carriage assembly 30, which is connected to the rotating floor 26 by a connecting link 32, is slidably mounted beneath the second motor means 21 and actuable by hydraulic cylinder 34 for pivoting the rotating floor between the two positions as indicated in FIG. 1. A more detailed discussion of the carriage assembly can be found in U.S. Pat. No. 4,133,122, issued on Jan. 9, 1979 to William T. Girard et al.

Figure 2:
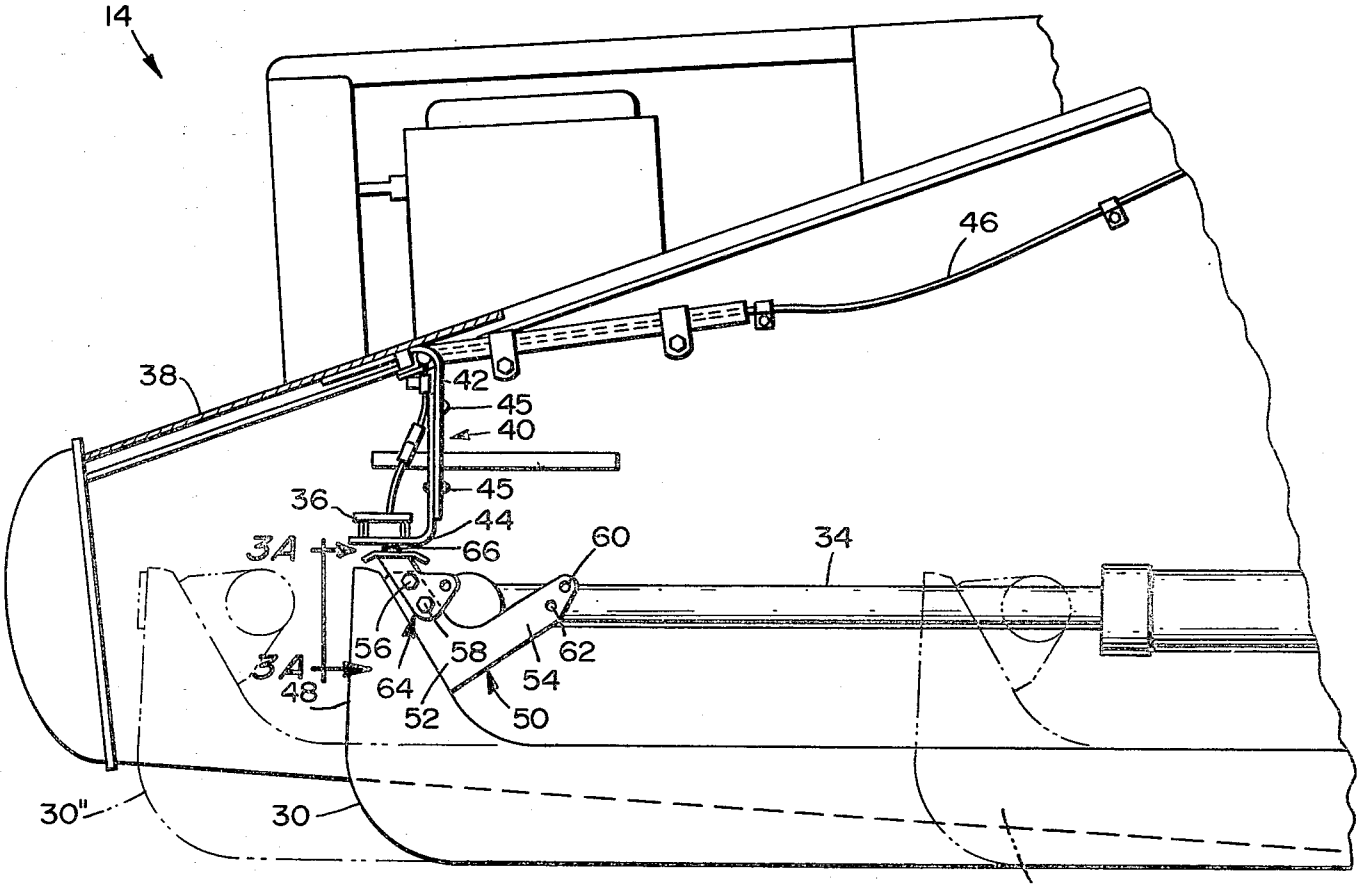
FIG. 2 is an enlarged portion, partially cut away of the scraper in FIG. 1 which includes the embodiment of the present invention.

Viewing FIG. 2, a magnetic proximity switch 36 is mounted to the frame 38 of the scraper assembly 14 by an adjustable bracket 40. Adjustable bracket 40 includes an upper member 42 and a lower member 44 which can be adjusted vertically by bolts 45 with respect to the member 42 to set the vertical position of magnetic proximity switch 36. Switch 36 provides a signal through conduit 46 to deactivate the hydraulic circuit which operates the hydraulic cylinder 34, as will be discussed more fully hereinbelow.

Figure 6:
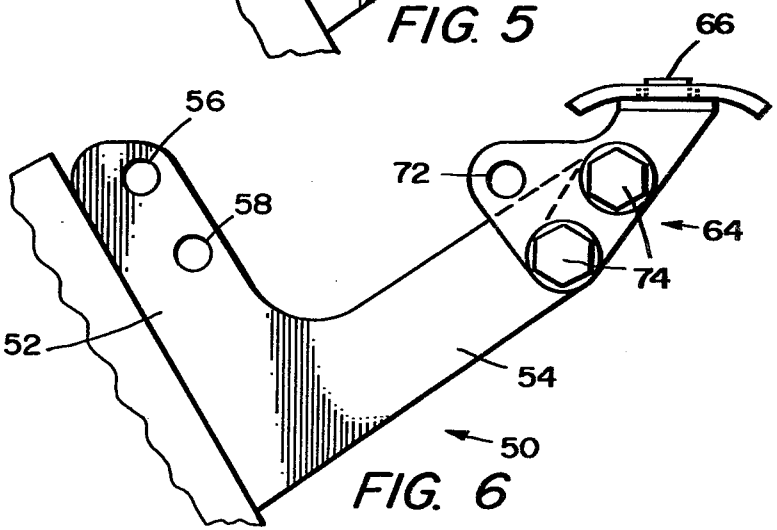
Figure 4:
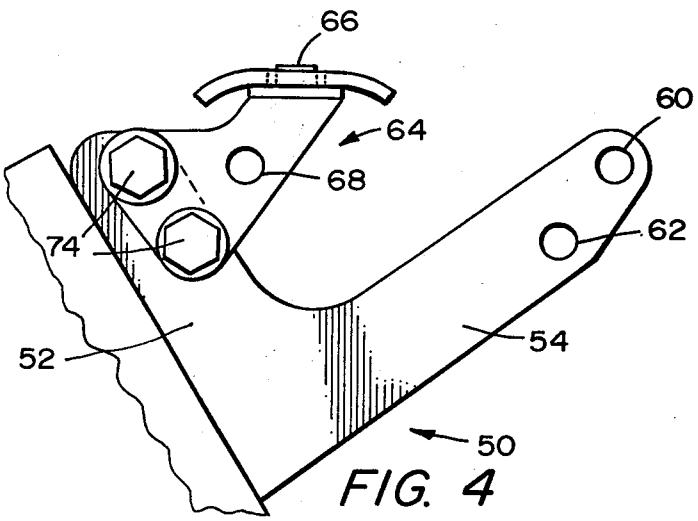

Secured to the rear, trailing upstanding portion 48 of carriage asembly 30 is a bracket 50 which has a first leg 52 and a second leg 54. As can be seen in FIG. 2, first leg 52 is secured to portion 48. First leg 52 includes first and second apertures 56 and 58, respectively (FIG. 6), and second leg 54 includes first and second apertures 60 and 62, respectively (FIG. 4). In a preferred embodiment bracket 50 can be V-shaped to allow access to cylinder 34. It is to be understood, however, that other configurations (not shown) of bracket 50 can allow access to cylinder 34.

Figure 5:
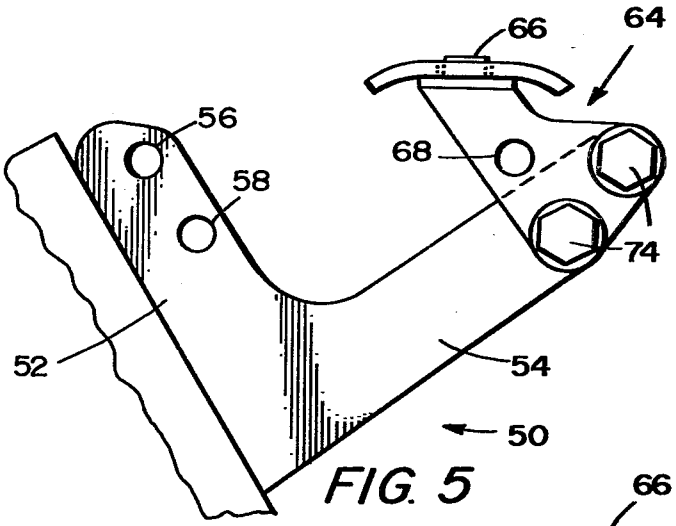
FIGS. 4, 5 and 6 depict the mounting bracket and adjuster plate of the invention with the plate positioned selectively with respect to the bracket to effect selective positioning of the pivoting floor and strikeoff blade of the bowl assembly of the scraper.
Figure 3:
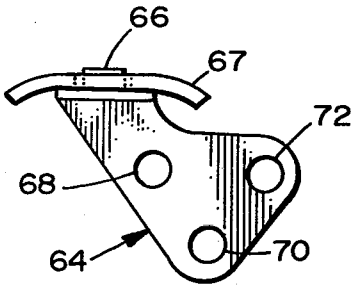
FIG. 3 is a side elevational view of the adjuster plate of the invention.
Figure 3A:
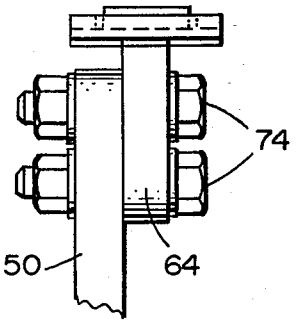
FIG. 3A is an end elevational view, looking in the direction of the arrows on line 3A—3A in FIG. 2.

The present invention further includes a triangularly shaped adjuster plate 64 to which is mounted an actuation means or magnet 66 for actuating the magnetic proximity switch 36. As can be seen in FIG. 3, adjustor plate 64 includes first, second and third apertures 68, 70 and 72, which are positioned in respective corners thereof. The magnet 66 is mounted on guide 67 of adjuster plate 64 adjacent aperture 68. It is to be understood that plate 64 can be selectively positioned and secured to bracket 50 by aligning the various apertures thereof and positioning bolts 74 therethrough (FIG. 3A). It is to be understood that in the position shown in FIG. 2, apertures 68 and 70 can be aligned with apertures 56 and 58 to position magnet 66 in a first of four positions. Also, plate 64 can be rotated 180° so that apertures 72 and 70 are aligned with apertures 56 and 58 (FIG. 4), to provide a second position of magnet 66 with respect to bracket 50. Still further, apertures 72 and 70 can be rotated 180° and aligned with apertures 60 and 62 of bracket 50 to provide a third position of magnet 66 as depicted in FIG. 5. Finally, apertures 68 and 70 of bracket 64 can be rotated 180° and aligned with apertures 60 and 62 of bracket 50 to dispose magnet 66 in a fourth position on bracket 50. With magnet 66 in the fourth position, the carriage 30 is most rearwardly extended to position 30", as shown in phantom in FIG. 2.

INDUSTRIAL APPLICABILITY

The operation of the present invention is as follows. For a given type of work to be performed and earth to be handled, the adjuster plate 64 can be manually positioned with respect to V-shaped bracket 50 in one of the positions shown in FIGS. 2, 4, 5 and 6 to preselect an open position for rotating floor 26 and strikeoff blade 26. As the bowl assembly 16 is being filled with earth collected by cutting edge 18 and elevator 20, the carriage is disposed in position 30', as indicated by phantom lines (FIG. 2) so that floor 26 is closed (FIG. 1). Once the bowl assembly 16 is filled and the scraper 10 is positioned preparatory to discharging the earth in the bowl assembly 16, the operator actuates an appropriate lever, causing hydraulic cylinder 34 to push carriage assembly 30 to a position where the magnet 66 actuates magnet proximity switch 36 to deactivate the hydraulic circuit which controls hydraulic jack 34. When this occurs, the rotating floor 26 and strikeoff blade 27 are appropriately positioned for the desired rate of discharge of earth from the bowl assembly 16 and the desired height of strikeoff blade 27.

It is to be understood that bracket 50 allows convenient maintenance access to hydraulic cylinder 34 between legs 52 and 54.

Other aspects, objects and advantages of this invention can be obtained from a study of the drawings, the disclosure and the appended claims.

We claim:

1. Apparatus for selectively controlling the position of a member (30) relative to a frame (38) comprising:
   - switch means (36) for controlling the position of the member (30);
   - first means (40) for securing said switch means (36) to either said member (30) or said frame (38);
   - actuation means (66) for actuating said switch means (36);
   - second means (50, 64) for selectively securing said actuation means (66) to the other of said member (30) and said frame (38) in a plurality of positions;
   - wherein said second securing means (50, 64) includes a bracket (50) secured to the other of said member (30) and said frame (38), which bracket (50) defines a first leg (52) and a second leg (54); and
   - wherein said second securing means (50, 64) includes an adjuster plate (64) to which said actuating means (66) is mounted, and means (74) for mounting said plate (64) to one of said legs (52, 54) of said bracket (50) in one or more positions.

2. The apparatus of claim 1 wherein said adjuster plate (64) includes first, second and third apertures (68, 70, 72) and each of said legs (52, 54) includes first and second apertures (56, 58, 60, 62) and wherein groupings of two of said plate apertures (68, 70, 72) are selectively alignable with said leg apertures (56, 58, 60, 62) to selectively position said plate (64) relative to said bracket (50).

3. The apparatus of claim 2 wherein said first, second and third apertures (68, 70, 72) of said adjuster plate (64) form the corners of a triangle and wherein said first and second apertures (68, 70) of said plate (64) are selectively alignable with the first and second apertures (56, 58, 60, 62) of each leg (52, 54) of said bracket (50) and said second and third apertures (70, 72) of said plate (64) are selectively alignable with the first and second apertures (56, 58, 60, 62) of each leg (52, 54) of said bracket (50).

4. In an earthmoving scraper (10) having a frame (38) mounting a bowl assembly (16) which bowl assembly (16) has a pivoted floor (26) a strikeoff blade (27) affixed to said floor (26) and means (30, 32, 34) for pivoting said floor (26) and strikeoff blade (27), the improvement comprising:
   - switch means (36) for controlling the position of said floor (26);
   - first means (40) for securing said switch means (36) to one of said frame (38) or said bowl assembly (16);

actuating means (66) for actuating said switch means (36);

second means (59, 64) for selectively securing said actuation means (66) to the other of said frame (38) or said bowl assembly (16);

wherein said second securing means (50, 64) includes a bracket (50) secured to the other of said frame (38) and said bowl assembly (16), which bracket (50) defines a first leg (52) and a second leg (54), and wherein said second securing means (50, 64) includes an adjuster plate (64) to which said actuating means (66) is mounted and means (74) for mounting said second bracket (64) to each leg (52, 54) of said bracket (50) in one or more positions.

5. The apparatus of claim 4 wherein said adjuster plate (64) includes first, second and third apertures (68, 70, 72) and each of said legs (52, 54) includes first and second apertures (56, 58, 60, 62) and wherein groupings of two of said plate apertures (68, 70, 72) are selectively alignable with said leg apertures (56, 58, 60, 62) to selectively position said plate (64) relative to said first bracket (50).

6. The apparatus of claim 5 wherein said first, second and third apertures (68, 70, 72) of said adjuster plate (64) form the corners of a triangle and wherein said first and second apertures (68, 70) of said plate (64) are selectively alignable with the first and second apertures (56, 58, 60, 62) of each leg (52, 54) of said bracket (50) and said second and third apertures (70, 72) of said plate (64) are selectively alignable with the first and second apertures (56, 58, 60, 62) of each leg (52, 54) of said bracket (50).

7. The apparatus of claim 4 wherein said means (30, 32, 34) for pivoting said floor includes a hydraulic cylinder (34) positioned behind said bracket (50) and wherein the improvement includes said legs (52, 54) of said bracket (50) defining a V-shape to allow access to said cylinder (34).

* * * * *